US008276785B1

(12) United States Patent
Wheatley et al.

(10) Patent No.: US 8,276,785 B1
(45) Date of Patent: Oct. 2, 2012

(54) NBC/CBRNE PERSONAL HYDRATION SYSTEM

(75) Inventors: David C. Wheatley, Aberdeen, MD (US); Patrick Hulbert, Dallastown, PA (US)

(73) Assignee: D. Wheatley Enterprise, Inc., Aberdeen, MD (US)

( * ) Notice: Subject to any disclaimer, the term of this patent is extended or adjusted under 35 U.S.C. 154(b) by 712 days.

(21) Appl. No.: 12/386,398

(22) Filed: Apr. 17, 2009

Related U.S. Application Data

(60) Provisional application No. 61/046,420, filed on Apr. 19, 2008.

(51) Int. Cl.
*B65D 35/00* (2006.01)

(52) U.S. Cl. ..... 222/107; 222/175; 383/80

(58) Field of Classification Search ..... 222/107, 222/215, 175; 383/80, 109, 110, 113, 116; 206/484, 484.1, 2; 220/211, 212, 5, 233, 220/254.8; 224/148.1–148.3
See application file for complete search history.

(56) References Cited

U.S. PATENT DOCUMENTS 3,187,965 A 6/1965 Bourget
3,229,014 A 1/1966 Petriello
3,642,047 A 2/1972 Waage
4,099,656 A * 7/1978 Neumann et al. ..... 294/157
4,362,255 A 12/1982 Bond
4,482,585 A 11/1984 Ohodaira et al.
4,526,298 A * 7/1985 Boxer et al. ..... 222/130
4,623,075 A 11/1986 Riley
4,636,412 A 1/1987 Field
4,928,681 A 5/1990 Langston et al.
4,955,512 A 9/1990 Sharples
4,984,713 A 1/1991 Chambers et al.
5,060,833 A 10/1991 Edison et al.
5,085,349 A 2/1992 Fawcett
5,100,033 A * 3/1992 Cho ..... 222/523
5,112,660 A 5/1992 Saito et al.
5,365,260 A 11/1994 Kitani et al.
5,472,124 A 12/1995 Martushev
5,603,436 A * 2/1997 Leoncavallo et al. ..... 222/525
5,727,714 A 3/1998 Fawcett
5,803,333 A 9/1998 Fawcett
5,988,435 A 11/1999 Edwards et al.
6,032,831 A 3/2000 Gardner et al.
6,070,767 A 6/2000 Gardner et al.
6,156,400 A 12/2000 Jing et al.
6,247,619 B1 6/2001 Gill et al.
6,364,168 B1 4/2002 Gardner et al.
6,497,348 B2 12/2002 Forsman et al.
6,626,342 B1 9/2003 Gleason
6,675,998 B2 * 1/2004 Forsman et al. ..... 224/148.2
6,820,780 B2 11/2004 Forsman et al.
6,892,915 B2 5/2005 Mares
(Continued)

*Primary Examiner* — Lien Ngo
(74) *Attorney, Agent, or Firm* — Whiteford, Taylor & Preston LLP

(57) ABSTRACT

A hydration system for providing fluid to a user. The system includes a bladder configured to hold a fluid, the bladder having a multilayer outer protective skin of a lightweight, durable thermoplastic laminate. A spout is connected to the bladder and in communication with the inside of the bladder and having a relatively large-diameter fill outlet for filling the bladder with fluid. A cap adapted to engage and close the fill port is included. A drinking tube in communication with the inside of the bladder extends from an exit port and includes a distal end upon which a mouthpiece may be mounted.
The fill port includes a three-part closure fitting having a sealing base portion, a sealing closure portion, and a sealing cap portion. Each portion includes flanges having mating ridges and troughs to provide a leak proof seal.

15 Claims, 10 Drawing Sheets

U.S. PATENT DOCUMENTS

| | | | | |
|---|---|---|---|---|
| 6,908,015 | B2 | 6/2005 | Choi et al. | |
| 7,063,243 | B2 | 6/2006 | Forsman et al. | |
| 7,070,075 | B2 | 7/2006 | Forsman et al. | |
| 7,073,688 | B2 | 7/2006 | Choi et al. | |
| 7,083,063 | B2 * | 8/2006 | Lien | 220/291 |
| 7,201,299 | B2 | 4/2007 | Forsman | |
| 7,398,891 | B2 * | 7/2008 | Yang | 220/212.5 |
| 2001/0042758 | A1 * | 11/2001 | DiTomasso et al. | 222/95 |
| 2002/0014498 | A1 | 2/2002 | Forsman et al. | |
| 2002/0179647 | A1 * | 12/2002 | Hall et al. | 222/175 |
| 2002/0193856 | A1 * | 12/2002 | Lu | 607/114 |
| 2003/0039781 | A1 | 2/2003 | D'Alessio et al. | |
| 2006/0231561 | A1 | 10/2006 | Choi et al. | |

* cited by examiner

NBC/CBRNE PERSONAL HYDRATION SYSTEM

CROSS REFERENCE TO RELATED APPLICATION

This application is based upon and claims benefit of copending and co-owned U.S. Provisional Patent Application Ser. No. 61/046,420 entitled "CBW Safe Hydration System", filed with the U.S. Patent and Trademark Office on Apr. 19, 2008 by the inventors herein, the specification of which is incorporated herein by reference.

BACKGROUND OF THE INVENTION

1. Field of the Invention

This invention generally relates to the field of liquid containers and, in particular, to a flexible container for storing and dispensing liquids and that can provide safe drinking fluids in a contaminated environment.

2. Background of the Prior Art

The threat of chemical and biological warfare has accelerated the implementation of protective clothing for military and HAZMAT personnel. This protective clothing insulates aircrew personnel and accentuates the need for hydration during long or hot weather missions. Decline in mental performance with lack of proper hydration has been well documented and it is likely that physical performance is also affected. Soldiers, civil service personnel, or any person in a hazardous environment must have the tools to hydrate in order to maintain peak performance even in a chemical or biological warfare (NBC/CBRNE) environment. Therefore, it would be desirable to have a personal hydration system designed for personal use to meet the hydration need, as well as provide NBC/CBRNE hardened protection of that water source from HD and GB agents. The hydration system, comprising a water bladder, fill outlet, drink tube, and connecting hardware can be designed for soldier and/or civil service personnel use with the NBC/CBRNE protective ensemble. The hydration system may be designed to integrate with existing hardware. Construction can be modular and would allow adaptation to military and non-military personal hydration configurations.

Major advantages of the flexible liquid containers over the rigid ones are their relatively easy storage, as they take up almost only as much space as needed for their contents and take very little space when empty. Another advantage of flexible containers over rigid ones is the convenience in transporting and in carrying them around. They conform to the shape of the body or vehicle that carries them. They integrate very well with other equipment carried in activities such as military and outdoor activities. Yet another advantage is that flexible containers are easily produced in various shapes and sizes, and their production cost is relatively low—this is true for both the production materials and the production tools. These advantages are especially valuable for military purposes or recreational purposes like jogging, cycling, mountaineering, camping etc.

U.S. Pat. No. 4,526,298 to Boxer et al. describes a sport hydration system having a flexible liquid container or bag, suspended from the shoulder. U.S. Pat. No. 5,085,349 to Fawcett discloses a resilient valve and dispensing system for bicyclists. The resilient valve was designed of an elastic material and had a cut at its top edge. In order to drink the user bites the valve thus forcing the cut on the valve open, and allowing the liquid to flow through.

However, flexible liquid containers have a disadvantage being vulnerable and easy to pierce or burst. This has led to solutions that seek to provide external means of defense to flexible bags.

U.S. Pat. No. 4,623,075 to Riley discloses a Bag-in Box type of container for pressurized liquid, consisting of a flexible bag located inside a tube of rigid or inelastic material or a sleeve of elastic material. U.S. Pat. No. 4,955,512 to Sharples discloses a liquid container and dispenser for controlled liquid dispensation, having a rigid or semi-rigid housing and an inner flexible bag. U.S. Pat. No. 4,984,713 to Chambers et al. describes a carbonated beverage dispenser, comprising a collapsible fluid holding container, disposed within an outer rigid container.

None of the above solutions discloses a hydration system that is both flexible (i.e. its external walls are flexible) and can provide protection to the contents in a contaminated environment.

Therefore, there is a need for a hydration system that can be used for military purposes or recreational purposes and that can provide safe drinking water and other fluids in an NBC/CBRNE contaminated environment.

SUMMARY OF THE INVENTION

It is, therefore, an object of the present invention to provide a hydration system that avoids the disadvantages of the prior art.

It is a main object of the present invention to provide a hydration system that is designed to fit in a variety of holding devices. It is a related object of the present invention to provide a hydration system that interfaces with currently available mask drinking systems.

Another object of the present invention is to provide a hydration system having a flexible liquid container that would be suitable for convenient transporting and for safe use in various outdoor activities.

It is another object of the present invention to provide a hydration system having a low profile. A related object is to provide a hydration system having a variable fluid capacity. A further related object is to provide a hydration system that can be decontaminated and reused.

A further object of the present invention is to provide a hydration system having a flexible, tough outer skin. A related object is to provide a hydration system that is tear and abrasion resistant. It is yet another object of the present invention to provide a hydration system having a flexible liquid container based on an impermeable, inexpensive, replaceable, odorless, and tasteless inner bag, inside a durable outer bag.

The present invention relates to a hydration system for providing fluid to a user, comprising: a bladder configured to hold a fluid; a multilayer outer protective skin, wherein the skin comprises a layer of a chemically resistant composite; a spout connected to the bladder and in communication with the inside of the bladder, wherein the spout comprises a fill port for filling the bladder with fluid; a cap adapted to engage and close the fill port; a tube connected to the bladder and in communication with the inside of the bladder, having a first end connected to an exit port of the bladder and having a second end connected to a fluid delivery fitting. In this system, the bladder may be flexible; the bladder may comprise an inner layer of thermoplastic polyurethane; the second end of the tube may connect to a closable, rigid drink straw; the drinkstraw may be made of metal; the cap may be adapted to screw into the fill outlet.

In another broad respect, this invention is a method of storing a fluid, comprising: at least partially filling the hydration system with a fluid, and closing the system by engaging the cap to the fill port, wherein the hydration system comprises: a bladder configured to hold a fluid; a multilayer outer protective skin, wherein the skin comprises an outer layer of fluorinated rubber composite; a spout connected to the bladder and in communication with the inside of the bladder, wherein the spout comprises a fill port for filling the bladder with fluid; a cap adapted to engage and close the fill port; a tube connected to the bladder and in communication with the inside of the bladder, having a first end connected to an exit port of the bladder and having a second end connected to a fluid delivery fitting.

In another broad respect, this invention is a bladder to store fluid, comprising an inner bladder layer of a thermoplastic polymer and an outer bladder encompassing the inner bladder, wherein the outer bladder layer comprises a tear and abrasion resistant layer. The inner bladder layer can be comprised of thermoplastic polyurethane. The outer bladder can be comprised of a multiple elastomer layers. The bladder can include a hole to fill the bladder with liquid. The hole can be mounted with a spout and cap.

The fluid used with the hydration system of this invention may be water, or any other fluid. The particular selection of fluid is not critical in the practice of this invention.

In one embodiment, this invention provides a durable, flexible hydration system resistant to contamination by contact with GB and HD chemical agents, and may be of many different designs for a wide range of end users. In deciding on a design, there are often conflicting concerns of water potability and protection from chemical agents in compliant polymeric materials. Water potability and health concerns dictate the use of high purity thermoplastic resins with very limited use of lubricants, accelerators, antioxidants, and plasticizers. Flexible chemically resistant applications demand the use of highly crosslinked, permeation resistant, plasticized elastomers, or thermosets. By using multilayer laminated and unlaminated polymer composites, as well as closely examining permeation properties, a balance has been reached to meet these conflicting requirements.

In one non-limiting respect, this invention is a water pouch for use by aviators. The NBC/CBRNE flexible hydration system is designed to integrate with existing hardware, in order to integrate with the soldier's equipment. This requirement necessitates flexibility because the water pouch is worn directly against the body, with several components mounted on the outside of the vest. Additionally, the pouch is designed to connect directly to a protective mask. The military mask connects to the canteen cap via the drinking tube and attached connector supplied with the mask system using, for example, an ethylene propylene diene monomer (EPDM) rubber tube and a metal drinking straw. The cap, however, is a large, stiff component that does not fit comfortably on the soldier or user. Instead, a low profile fill outlet is used, with a separate connection for the drink tube.

In accordance with the above objects, an NBC/CBRNE safe hydration system is disclosed. The hydration system comprises a chemical-biological warfare resistant water pouch to provide safe drinking water in contaminated environments. The water pouch is designed to fit in a variety of holding devices and interfaces with currently available mask drinking systems.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF PREFERRED EMBODIMENTS

The invention summarized above and defined by the enumerated claims may be better understood by referring to the following description, which should be read in conjunction with the accompanying drawings in which like reference numbers are used for like parts. This description of an embodiment, set out below to enable one to practice an implementation of the invention, is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

A tough, durable, hands-free, NBC protective, drink bag is designed for the stringent requirements of ground troops and military aviators. It is also well suited for use by Department of Defense personnel and municipal HazMat teams involved in emergency response of NBC and hazardous materials. In a preferred embodiment, the tough outer skin meets NFPA performance requirements (NFPA, 1991, 1994 ed. Std.).

The hydration system of present invention was developed to exceed the capabilities of the previous generation two-quart canteen. The previous generation two-quart canteen used by the US military was designed for neither chemical and biological warfare use nor aviator use. This ethylene-vinyl acetate (EVA) canteen only provided a "disposable" NBC/CBRNE solution for ground forces. The new hydration system, comprising a water bladder, fill outlet, drink tube, and connecting hardware can be designed for use by all soldiers, ground troops, and aviators. The hydration system may be designed to integrate with existing MOLLE Systems and can be adapted to fit various military configurations. Construction can be modular and would allow adaptation to other military and non-military personal hydration configurations.

Figure 1:
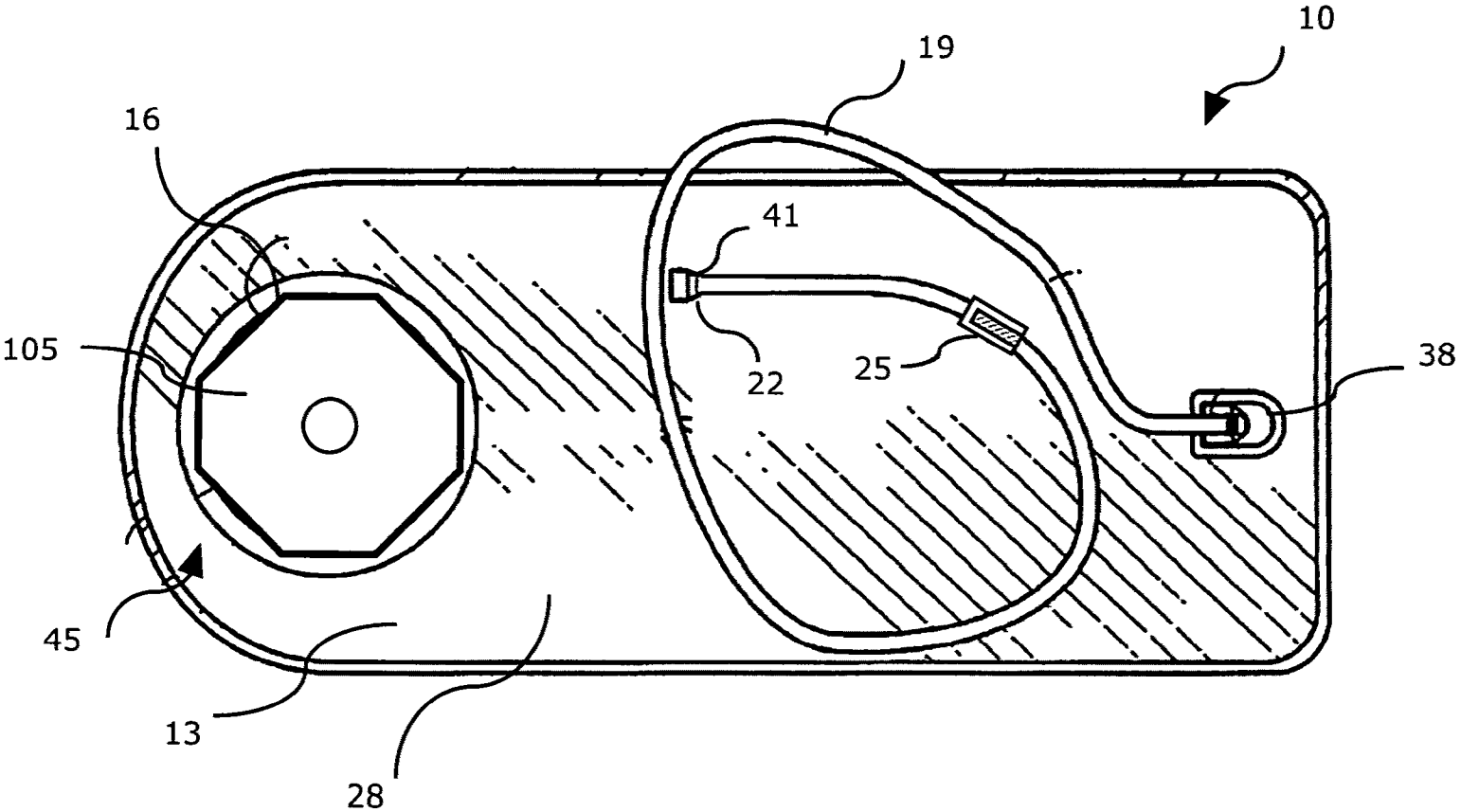
FIG. 1 shows a top plan view of a hydration system according to one embodiment of the present invention.
Figure 2:
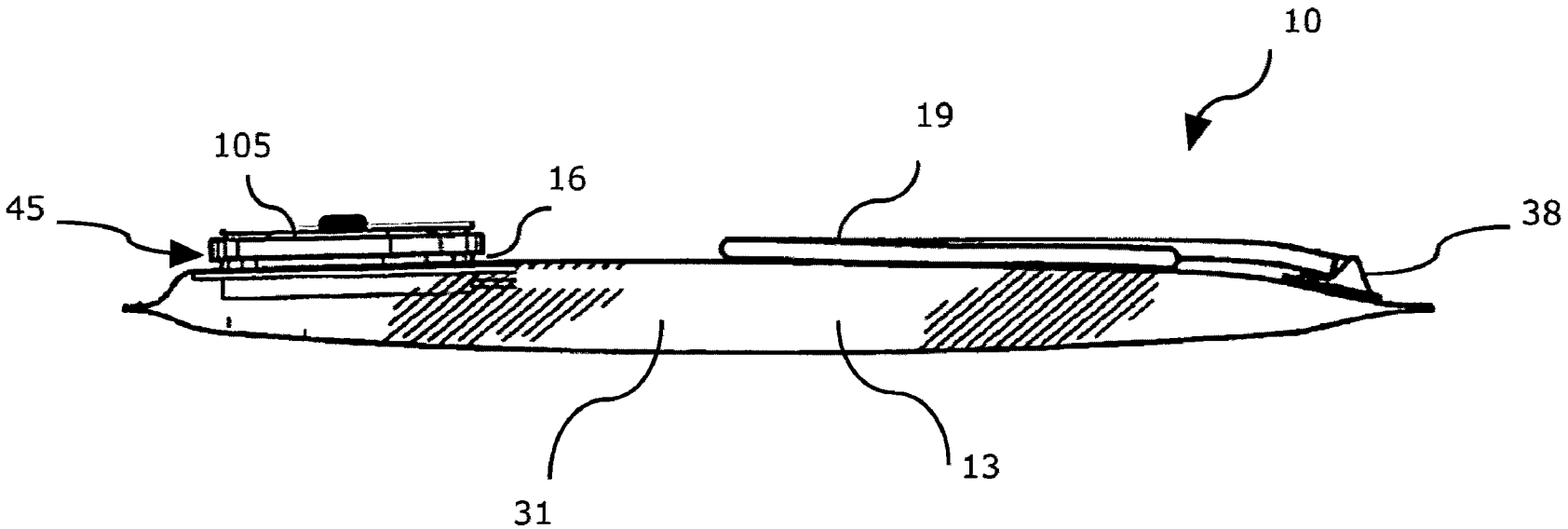
FIG. 2 shows a side elevational view of the hydration system of FIG. 1.
Figure 3:
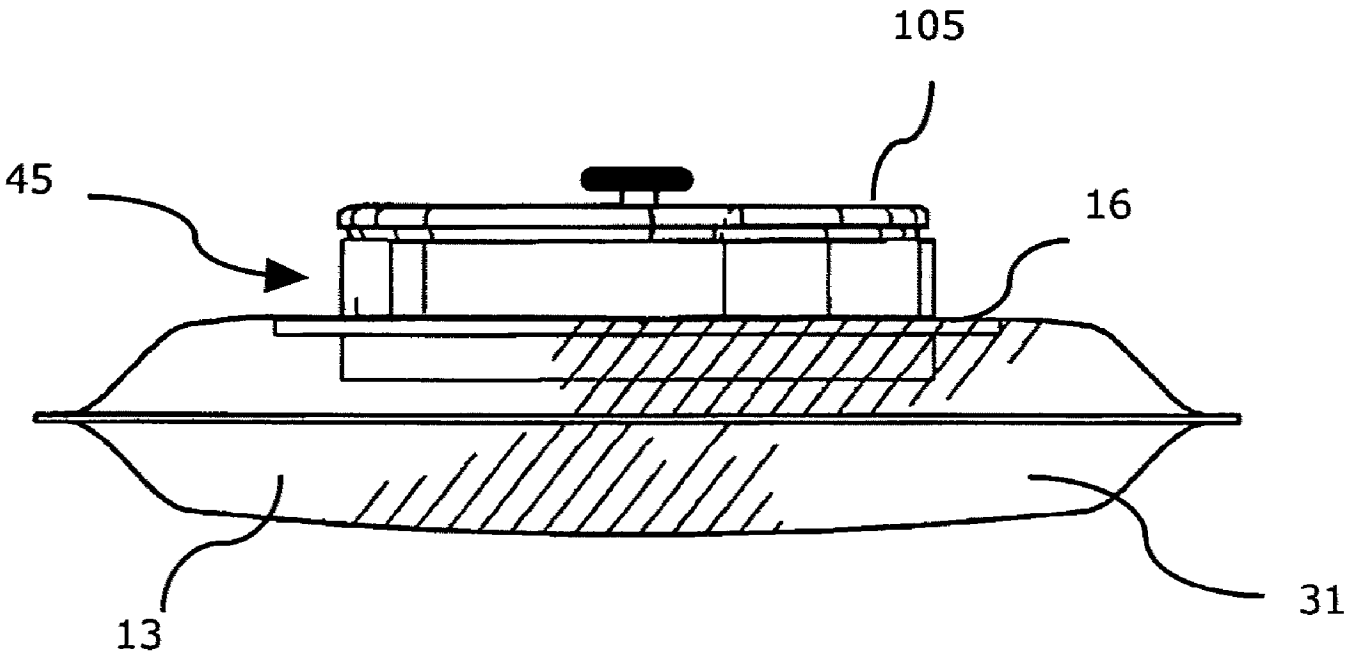
FIG. 3 shows an end elevational view of the hydration system of FIG. 1.

Referring now to the drawings, FIG. 1 shows a top view of a hydration system, indicated generally as 10, of the present invention. FIG. 2 is a side view of the hydration system 10 and FIG. 3 is an end view of the hydration system. The hydration system 10 includes a bladder 13, a fill port 16, a drinking tube 19, and a fluid delivery fitting 22 that is configured to provide fluid to a user and which can be closed when not in use, and a valve 25 that serves to stop the flow of fluid through the tube 19. The fluid delivery fitting 22 may be in the form of a mouthpiece, such as are well known in the art, for direct use by a user. The particular style and construction of the fluid delivery fitting 22 is not critical in the practice of this invention. The fluid delivery fitting 22 may also be configured to engage a separate delivery device, such as a metal drinkstraw that is used currently by aviators and in this regard may be considered a drink tube adapter (or drinkstraw adapter). As used herein, "fluid delivery fitting" refers to either of these alternatives unless otherwise specified.

The bladder 13 includes a body portion 28 with an internal compartment 31, which is adapted to store a volume of fluid, such as water, sports drinks, juice, etc. At least the body portion, if not the entirety, of bladder 13 is formed from a flexible, waterproof material. An example of a suitable material is polyurethane, although others may be used. The size and shape of the internal compartment 31 may vary, such as depending upon the desired application with which the system will be used, any compartment or pack into which the hydration system 10 will be placed, the mechanism by which the hydration system 10 will be transported, and the volume of drink fluid that internal compartment 31 is designed to hold. The bladder 13, which may be composed of an inner thermoplastic polyurethane bladder layer and an outer composite layer, defines the internal compartment 31 that holds fluid (the bladder is hollow), the fluid being in direct contact with the polyurethane layer. The outer layer is formed from a chemically resistant polymer composite that serves to protect the inner bladder layer from aggressive chemicals and biological agents. (See FIG. 4.)

The fill port 16 preferably has a low profile. The fill port 16 may include a corresponding threaded cap to engage and cover the fill port 16, as described below in greater detail. The tube 19 is connected to bladder 13 by an exit port 38 through which drink fluid in the bladder 13 is received into tube 19. In other words, internal compartment 31 is in fluid communication with the exit port 38. Examples of suitable exit ports 38 are disclosed in U.S. Pat. Nos. 5,085,349 and 5,727,714, the complete disclosures of which are hereby incorporated by reference. Tube 19 may be integrally formed or otherwise fixedly attached to bladder 13 and/or exit port 38, or alternatively tube 19 may be selectively removed from and reattached to the exit port 38.

The hydration system may include additional spouts, tubes, and fluid delivery fittings as desired. The hydration system 10 may be a variety of designs/configurations depending on the needs of the end use. In the configuration of FIGS. 1-3, the hydration system has a length that is greater than its width that is greater than its height. The hydration system 10 may also include an internal assembly, in communication with the exit port 38, so that fluid may be drawn from the very bottom of the hydration system 10 during use.

The length of tube 19 may vary, such as depending upon the desired distance between the user's mouth and the location where bladder 13 is positioned, such as on a user's back, waist, inside a user's garments, on a user's bike or other equipment, etc. The fluid delivery fitting 22 may have a variety of configurations, from an open end of tube 19, to a device that is coupled to the end of the tube, as mentioned above. An example of a suitable mouthpiece is a bite-actuated mouthpiece 41, which is placed in a user's mouth and configured from a closed, or sealed, position, to an open, or dispensing, position when a user bites upon the mouthpiece or otherwise compresses the mouthpiece with the user's lips or teeth. Examples of suitable bite-actuated mouthpieces are disclosed in U.S. Pat. Nos. 6,070,767, 5,085,349, and 5,060,833, the complete disclosures of which are hereby incorporated by reference.

Also shown in FIG. 1 is a manually actuated, in-line, on/off valve 25, which is used to selectively prevent drink fluid from being dispensed through the fluid delivery fitting 22, regardless of the configuration of the mouthpiece. By "manually actuated," it is meant that the on/off valve 25 is adapted to be actuated by a user exerting force on the valve, such as with the user's hands. Typically, a bite-actuated mouthpiece, or valve, will be self-sealing, in that it is adapted to automatically return to its closed position, while manually actuated on/off valves will typically remain in a selected position until repositioned by a user. By "in-line," it is meant that the valve 25 is positioned between adjacent lengths of tube 19, as opposed to being connected in an end-of-line configuration adjacent to the fluid delivery fitting 22. Valve 25 is described below with reference to FIG. 8.

Figure 4:
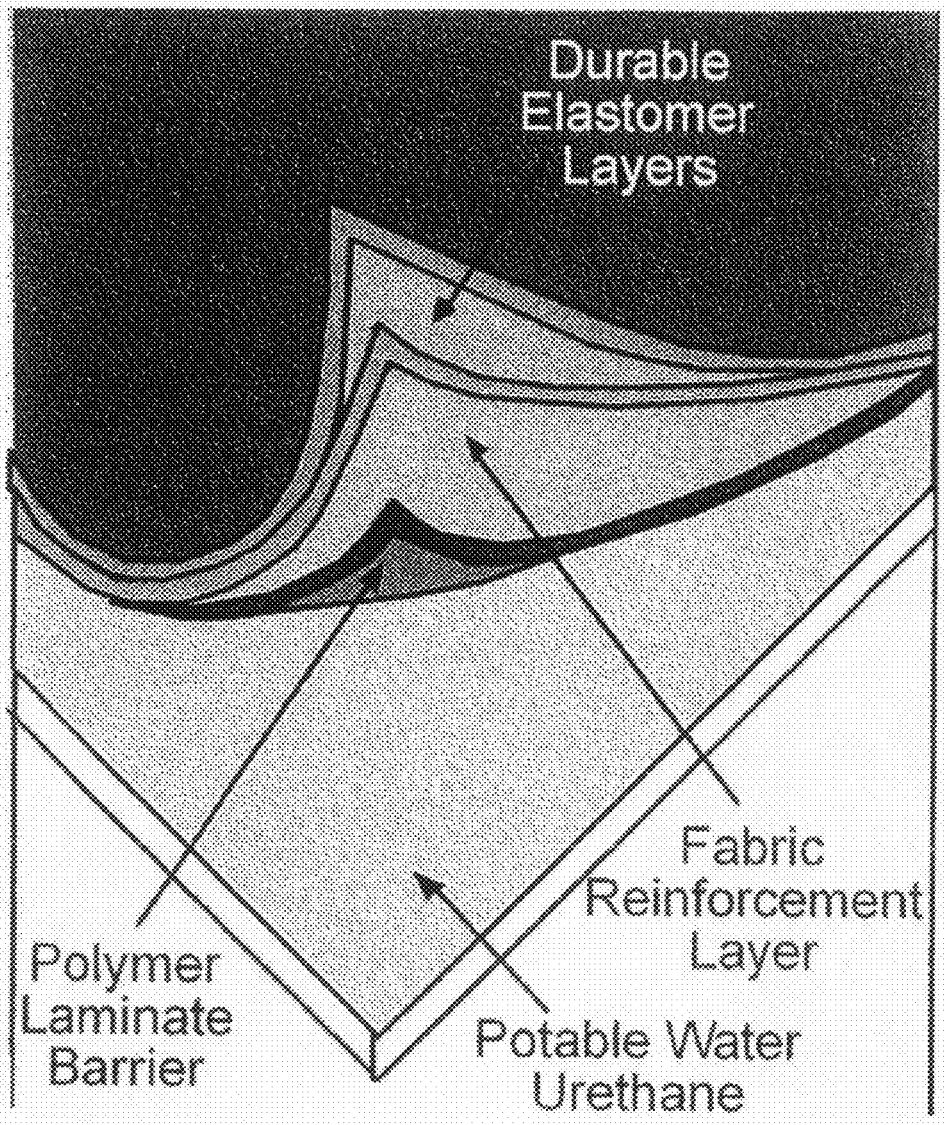
FIG. 4 shows a multilayer composite laminate cover according to one embodiment of the present invention.

FIG. 4 shows a multilayer composite sheet according to the present invention. In a typical embodiment of the flexible liquid container of the present invention, the inner collapsible impervious bag for dispensing liquid is made of a potable water compatible urethane, such as polyethylene, which has been found to be a material that, when used for food storing, does not impart a bad taste. However, polyethylene sheets are easily torn and cannot withstand high-pressure build up within.

The outer bag, on the other hand, is made of a non-stretching flexible material having a polymer laminate barrier and one or more durable elastomer layers. The multi-layer design incorporates a contamination resistant composite for the outer layer and a polyurethane inner layer for superior water potability. This configuration also gives maximum protection against leaks, cuts, and tears. In a preferred embodiment, the outer bag comprises a multi-layer cover having a durable elastomer layers, at least one fabric reinforcement layer, and a polymer laminate barrier. The inner bag comprises a water potable urethane. The multi-layer composite provides durability protection, strength, and water potability.

The barrier material has been proven against harmful agents including HD (mustard) and GB (satin); as well as, anhydrous ammonia, 1, 3 butdiene, butylamine, chloroform, diethyl ether, formaldehyde, hydrofluoric acid, methanol, monochlorobenzene, nitric acid, sulfuric acid, dimethyl sulfoxide, and many others. A suitable material for the outer protective skin is Trellechem HPS multilayer laminate. Another suitable material, which can be used separately or in combination with the Trellechem HPS multilayer laminate, is DuPont NBC multilayer, multibarrier, thermoplastic laminate. Other equivalent materials from other manufacturers may be used.

Referring to FIGS. 5-7, bladder 13 includes an opening surrounded by fill port 16, through which drink fluid may be poured into or removed from the internal compartment 31. Fill port 16 also provides a passage through which the interior of bladder 13 may be accessed, such as for cleaning. As shown, fill port 16 includes a three-part closure fitting 45 that extends from the body portion of the bladder 13 and includes an opening 48 through which drink fluid may enter or exit the fill port 16. Although the bladder 13 is preferably flexible, the closure fitting 45 should tend to retain its configuration and thereby maintain a seal with the below described sealing members.

Figure 5B:
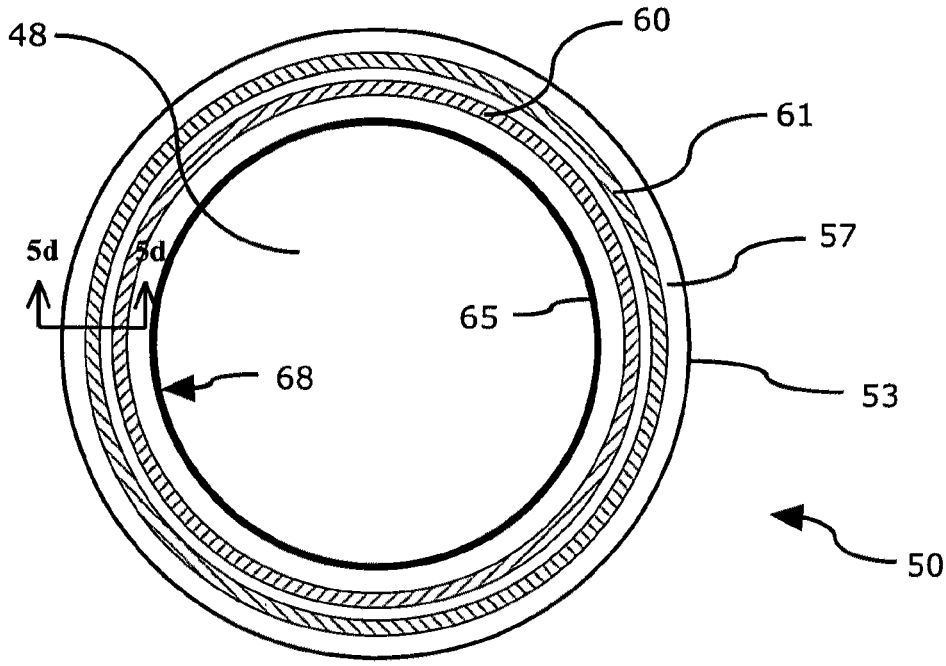
FIG. 5*b* shows a top plan view of the base portion of FIG. 5*a*.
Figure 5A:
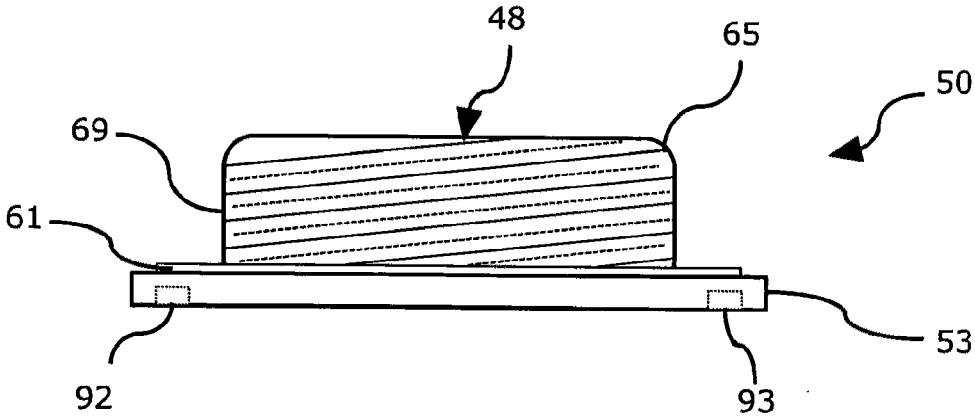
FIG. 5*a* shows a side elevational view of a base portion of the fill outlet for the hydration system according to one embodiment of the present invention.
Figure 5C:
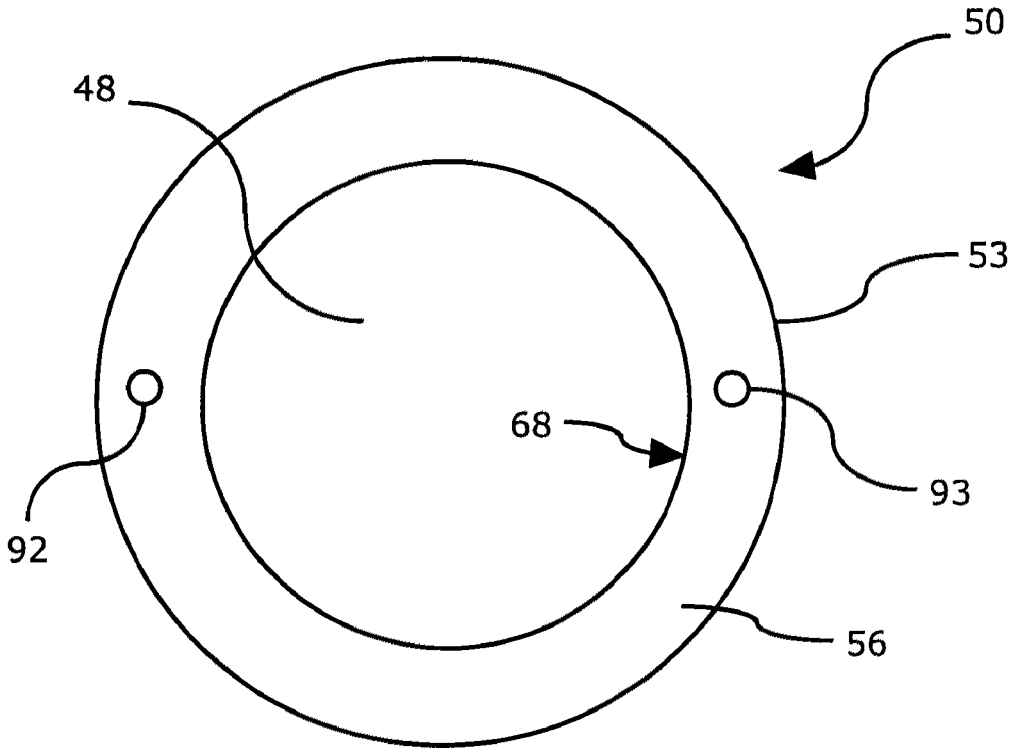
FIG. 5*c* shows a bottom plan view of the base portion of FIG. 5*a*.
Figure 5D:
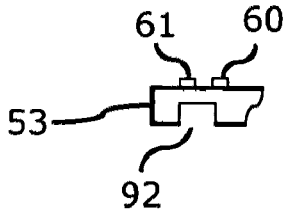
FIG. 5*d* shows a cross section of the base portion taken along the line 5*d*-5*d* of FIG. 5*b*.

FIG. 5*a* shows the sealing base portion 50 of the closure fitting 45. The sealing base portion 50 comprises a flange 53, designed to fit through an opening in the bladder 13, and having a substantially flat bottom 56 (FIG. 5*c*). The top 57 of flange 53 has at least one and preferably a plurality of concentric ridges 60, 61 (FIGS. 5*b* and 5*d*). The base portion 50 further comprises a neck 65 having a threaded surface on both the inner surface 68 and outer surfaces 69 of neck 65. In a preferred embodiment, the threading on the outer surface 69 is more compact than the threading on the inner surface 68. Typically, the closure fitting 45 will have a defined shape, such as circular as shown in FIGS. 5-7.

The flange 53 extends radially outward from neck 65. In a preferred embodiment, some of the material of the body portion 28 of the bladder 13 extends over at least a portion of the flange 53; however, it is most preferred that the body portion 28 extend fully over the top 57 of flange 53 and at least partially up the neck 65.

Preferably, opening 48 is sized to reduce spilling when the bladder 13 is filled, because there is a larger opening through which fluid may be poured, and enables the addition of larger pieces of ice than could be passed through conventional input ports. Preferably, opening 48 has a diameter of at least 2.5 inches. Other sizes may be used, such as a diameter that is greater than 3 inches, a diameter that is greater than 4 inches, a diameter that is in the range of 3 to 4 inches, and a diameter that is in the range of 3 to 5 inches. This increased diameter as compared to conventional reservoirs allows the internal compartment 31 to be more thoroughly and easily cleaned. Similarly, cloths or brushes may be passed through the opening 48.

Figure 6B:
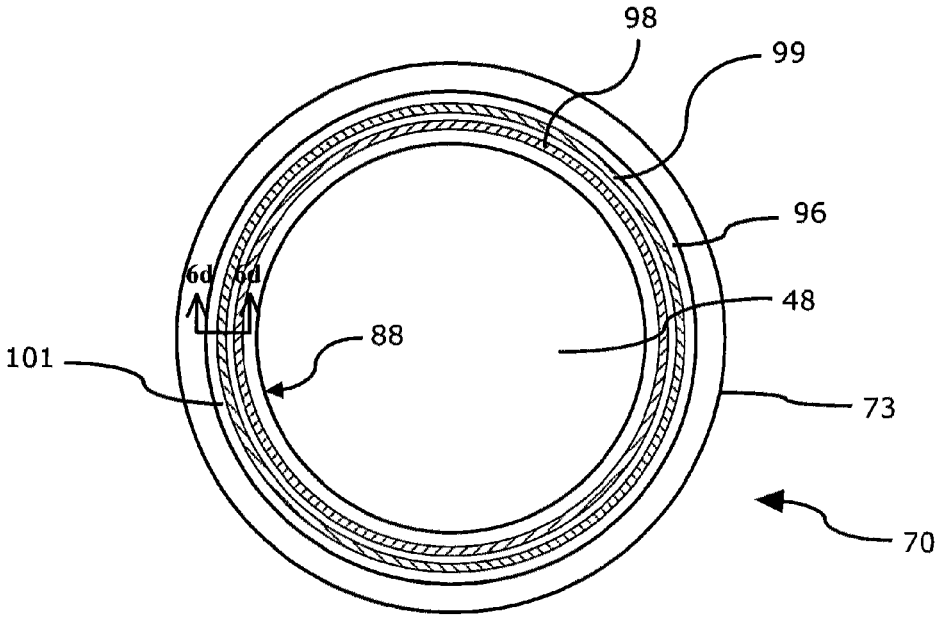
FIG. 6*b* shows a top plan view of the seal closure portion of FIG. 6*a*.
Figure 6A:
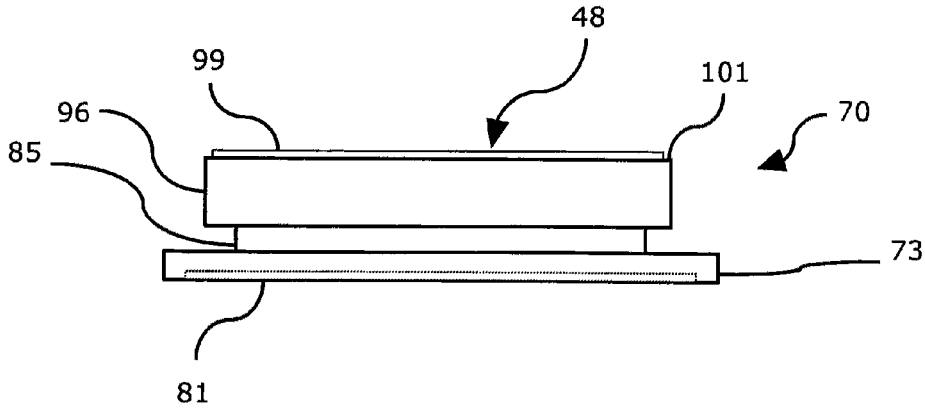
FIG. 6*a* shows a side elevational view of a seal closure portion of the fill outlet for the hydration system according to one embodiment of the present invention.
Figure 6C:
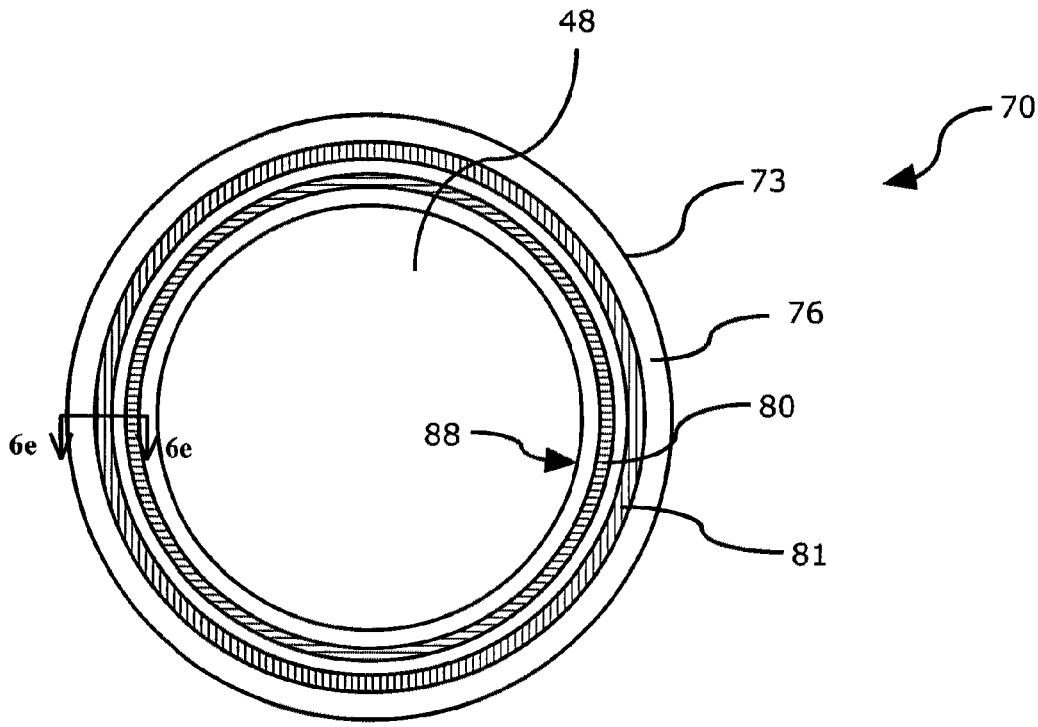
FIG. 6*c* shows a bottom plan view of the seal closure portion of FIG. 6*a*.

FIG. 6*a* shows the sealing closure portion 70 of the closure fitting 45. The sealing closure portion 70 comprises a lower flange 73, designed to engage with the flange 53 of the sealing base portion 50. The bottom 76 of flange 73 has at least one and preferably a plurality of concentric troughs 80, 81 (FIGS. 6*c* and 6*e*). The troughs 80, 81 are sized and configured to engage with concentric ridges 60, 61, respectively, of the sealing base portion 50. The sealing closure portion 70 further comprises a body 85 having a threaded surface on its inner surface 88, sized and configured to engage the threads on the outer surface 69 of the neck 65 of the sealing base portion 50. Some of the material of the body portion 28 of the bladder 13 may be secured between flanges 53, 73 to provide leak prevention when the body 85 of the sealing closure 70 is threaded onto the neck 65 of the sealing base 50.

The bottom 56 of flange 53 may further comprise one or more indentations 92, 93, as shown in FIG. 5*c*. In order to tighten the connection between the base portion 50 and sealing closure portion 70, a wrench or other similar device can be inserted into the opening 48 to engage the one or more indentations 92, 93 and hold the base portion 50 while threading the sealing closure portion 70 in place.

Figure 6D:
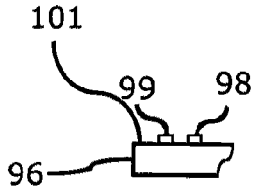
FIG. 6*d* shows a cross section of the bottom of the seal closure portion taken along the line 6*d*-6*d* of FIG. 6*b*.
Figure 6E:
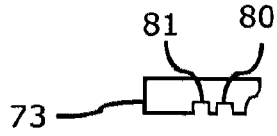
FIG. 6*e* shows a cross section of the top of the seal closure portion taken along the line 6*e*-6*e* of FIG. 6*c*.

The sealing closure portion 70 of the closure fitting 45 further comprises an upper flange 96 having at least one and preferably a plurality of concentric ridges 98, 99 on the top 101 thereof (FIGS. 6*b* and 6*d*).

Referring to FIG. 7, the closure fitting 45 further includes a filler cap 105 that is adapted to be secured to closure fitting 45 to obstruct opening 48 and thereby prevent drink fluid from passing therethrough. The filler cap 105 is selectively secured to neck 65 to prevent drink fluid from passing through the opening 48. Neck 65 and cap 105 are selectively secured together by any suitable releasable fastening mechanism that permits the cap 105 to be secured to the neck 65 to prevent drink fluid from passing through opening 48, and also to be selectively removed from the neck 65, such as to add or remove drink fluid from the bladder 13 or to clean the bladder, and thereafter be re-secured thereto.

Figure 7B:
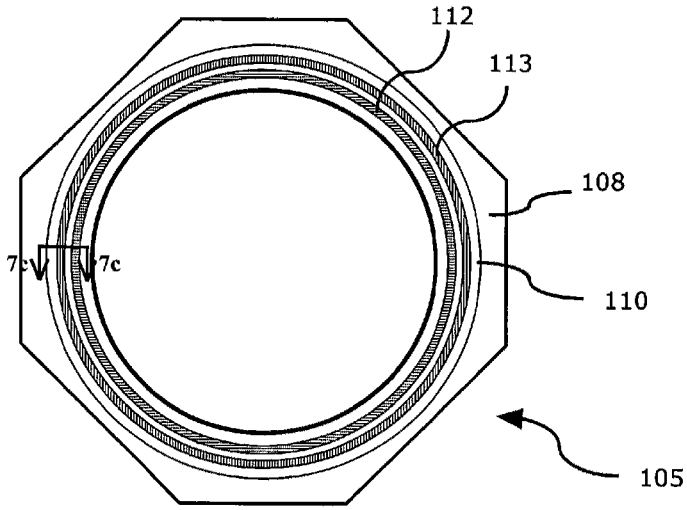
FIG. 7*b* shows a bottom plan view of the cover portion of FIG. 7*a*.
Figure 7C:
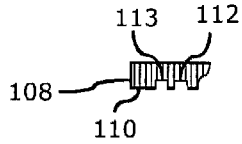
FIG. 7*c* shows a cross section of the cover portion taken along the line 7*c*-7*c* of FIG. 7*b*.
Figure 7A:
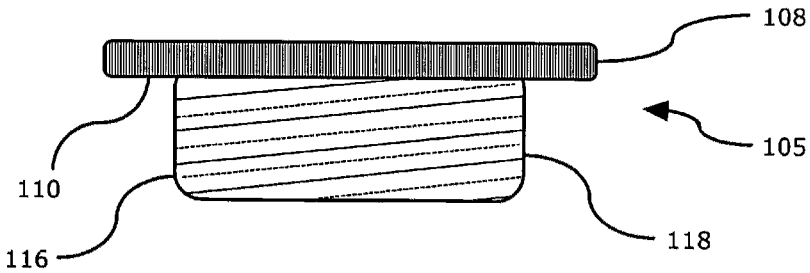
FIG. 7*a* shows a side elevational view of a cover portion of the fill outlet for the hydration system according to one embodiment of the present invention.

Filler cap 105 preferably forms a watertight seal with fill port 16. This seal may be provided by the sealing mechanism used to secure filler cap 105 to fill port 16. As shown in FIGS. 7*a* and 7*b*, filler cap 105 comprises a flange 108, designed to engage with the flange 96 of the sealing closure portion 70. The bottom 110 of flange 108 has at least one and preferably a plurality of concentric troughs 112, 113 (FIGS. 7*b* and 7*c*). The troughs 112, 113 are sized and configured to engage with concentric ridges 98, 99, respectively of the sealing closure portion 70. The filler cap 105 further comprises a body 116 having a threaded surface on its outer surface 118, sized and configured to engage the threads on the inner surface 68 of the neck 65 of the sealing base portion 50. Tightening of the filler cap 105 provides additional force to squeeze the material of the body portion 28 of the bladder 13 between flanges 53, 73 to provide additional leak prevention. Additionally or alternatively, the filler cap 105 may include a seal member, such as a gasket (not shown) that provides increased protection against leaks.

It is contemplated that wherever concentric ridges are used, they can be exchanged for concentric troughs, and vice versa, provided the corresponding matching flange is also so changed.

Upon release from fill port 16, filler cap 105 may be free from association with the hydration system 10; meaning that the filler cap 105 is not coupled or retained near the hydration system 10. A benefit of such a configuration is that the filler cap 105 may be moved to any selected position regardless of the corresponding position of the bladder 13. A disadvantage of such a configuration is that the filler cap 105 may be misplaced, lost, dropped, etc. Therefore, filler cap 105 may additionally include a tether, or lanyard, that couples the filler cap 105 to the hydration system 10 when the filler cap 105 is released from the fill port 16, and thereby limits the degree to which the filler cap 105 may be removed from the hydration system 10. For example, a tether may interconnect the filler cap 105 with the bladder 13; fill port 16, closure fitting 45, or other portion of the hydration system 10.

Figure 8:
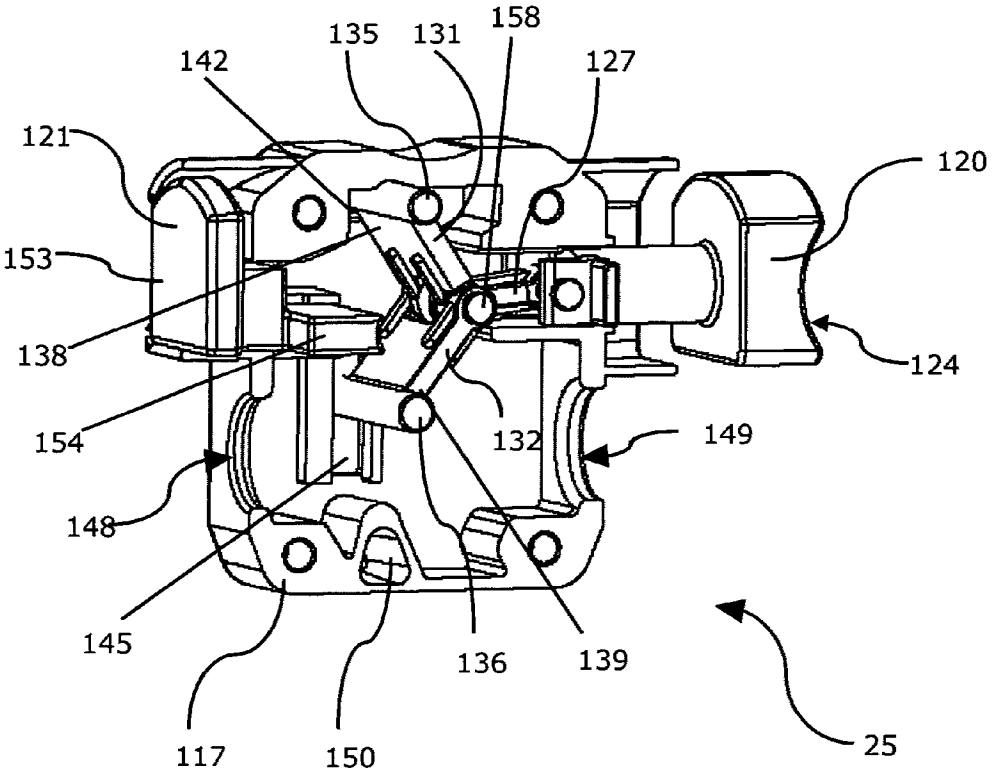
FIG. 8 shows a cutaway view of a valve for the hydration system according to one embodiment of the present invention.

FIG. 8 shows a valve 25 that can be used with the present invention. The valve 25 comprises a body 117 made of two symmetric halves. Mounted within the body 117 is a first actuator 120 for closing the valve 25 and a second actuator 121 for opening the valve. The first actuator 120 comprises a pushbutton 124 hindgedly attached to a linkage arm 127, which is further connected to a pair of hinge plates 131, 132. Each hinge plate 131, 132 has a rounded extension 135, 136 on its distal end 138, 139, respectively. The rounded extension 135 on the end 138 of hinge plate 131 is rotatably engaged in a circular depression 142 formed in the body 117.

In operation, the end 138 of hinge plate 131 cannot move laterally, but can rotate within the depression 142. The rounded extension 136 on the end 139 of hinge plate 132 is constrained in a track 145 formed in the body 117. In operation, the end 139 of hinge plate 132 can slide along the track 145. The body is designed with openings 148, 149 to enable the tube 19 (FIG. 1) to be held within the valve 25. As the pushbutton 124 is moved to a closed position, the first actuator 120 pushes against the linkage arm 127, which pushes against hinge plates 131, 132. Because the rounded extension 135 on the end 138 of hinge plate 131 is held in the circular depression 142, the linkage arm 127 and the rounded extension 136 on the end 139 of hinge plate 132, which is only capable of moving along the track 145, are forced to move toward the tube 19. The rounded extension 136 pinches the tube 19 against a detent 150 thereby closing off flow in the tube 19. Once the hinge plates 131, 132 pass an in-line position, they tends to remain in place, keeping the tube 19 pinched closed.

The second actuator 121 comprises a pushbutton 153 having an arm 155 positioned to strike approximately the end 158 of the linkage arm 127 when the valve 25 is in the closed position. As the pushbutton 153 is moved to an open position, the arm 155 pushes against the end 158 of the linkage arm 127, forcing the hinge plates 131, 132 out of line. The resilient nature of the material of the tube 19 causes the tube to open.

The bladder 13 typically holds from one pint to two gallons of fluid, though greater volumes can be held. The bladder is made up of at least two layers, and may include a fluorinated rubber layer and a thermoplastic polyurethane layer. The fluorinated rubber composite layer itself can contain multiple layers and/or components, and may include in this regard polyimide reinforcement. Stated differently, this embodiment provides a pouch within a pouch, with the inner bladder forming a reservoir in contact with the fluid. Thus, though the layers can be bonded together, the thermoplastic polyurethane layer and the fluorinated rubber layer need not be bonded to one another. Though not necessarily bonded together, the inner and outer bladder layers may of course be in full, contiguous contact when the hydration system 10 is filled with a fluid.

While a variety of polymeric materials can be employed, aromatic thermoplastic polyurethane is the preferred inner bladder material to come in contact with the fluid for several reasons. First, it is flexible and tough over a wide temperature range without the use of plasticizers. Ultimate elongations of 500 to 600 percent are typical for urethanes without plasticizers. Other polymers such as PVC require additives to retain flexibility at room temperature, and still become brittle at near freezing temperatures. With regards to mechanical properties, the only other competing materials are elastomers, or rubbers. However, rubbers must be crosslinked by vulcanization using sulfur to obtain useful mechanical properties. Unreacted sulfur or accelerators, even in very small amounts, impart a foul taste to water that contacts it for any significant period of time. Additionally, typical rubbers must be chemically glued together, whereas polyurethane is a thermoplastic that readily forms strong thermal welds. Chemical bonding introduces another set of potentially toxic chemicals to drinking water and can be less reliable mechanically. The only problem with thermoplastic urethane is that it has relatively low resistance to permeation by chemical agents. An outer barrier was therefore employed.

For the outer protective covering, a chemically resistant composite is employed. One representative example of such a chemically resistant composite layer is fluorinated polymer such as fluorinated rubber. A multilayer laminate already proven worldwide in industrial chemical protective applications can be utilized. This laminate meets performance requirements, including permeation, flammability, and abrasion resistance, of the National Fire Protection Association (NFPA) 1991, 1994 edition standard. This laminate may be composed of several polymeric layers including a polyamide fiber reinforcement layer for strength, several rubber layers for permeation resistance, and a thermoplastic layer to allow for thermal welding. More particularly, the multiplayer laminate/composite includes a layer of fluorinated polymer such as fluorinated rubber. This layer may include other rubber materials. A representative example of such a fluorinated rubber is Viton™ rubber available from DuPont. These fluorinated rubbers may be based on hexafluoropropylene and vinylidene fluoride. Such materials are well known as being chemically resistant. Thus, in general, the fluorinated rubber composite may be multiplayer and include a polyamide reinforcement layer sandwiched between a thermoplastic polymer layer (to all for thermal welding) and the fluorinated rubber. As used herein, "fluorinated rubber composite" or "fluorinated rubber laminate" refers to materials that include one or more fluorinated rubber layers, but may include other layers such as the polyamide and thermoplastic polymer layers. It is possible that other chemically resistant polymers be used instead of fluorinated rubber.

The tubing employed may be of a variety of lengths and diameters, depending on the end use. The tubing is typically made of flexible plastic tubing, such as silicon tubing and vinyl polymer tubing (e.g., Tygon™ tubing). For military applications, the requirements for the tubing are not entirely similar to those for the pouch material. First, the tubing must be stiff enough to prevent collapse, but flexible enough to prevent kinking and allow ease of movement. Unfortunately, flexibility is usually related to permeability. Secondly, the tubing must be of a type approved for contact with potable water. It would seem the ideal tubing would consist of a layer of highly resistant fluoropolymer over a soft, flexible potable water formulated polymer. TFE fluoropolymers are inherently stiff and prone to kinking. Multilayer tubing is prone to difficulties with reliably sealing both tubes at the ends. A single layer tubing with the ability to both carry potable water and resist permeation and damage by both NBC/CBRNE agents and decontaminants was required. By choosing a flexible, chemical resistant tubing of a sufficient thickness to keep the permeation rate low, all requirements could be met.

It should be understood that this invention is not limited to a water pouch as described in detail above. This hydration system 10 may be made in a variety of shapes and sizes, depending on a given end use. The bladder 13 may be fitted with alternative fittings such as the cap and tubing dispenser, or no tubing. The cap/drinking component may be arranged to provide a traditional canteen type design. The pouch may be itself contained in a rigid vessel depending on end use.

The inner bladder may be readily fabricated using standard thermal welding of the polymeric material. Similarly, the inner layer of the outer protective coating is advantageously formed from a thermoplastic material that affords the ability to thermally weld the material together in any desired shape. The outer seams so formed may optionally be reinforced using a chemical adhesive to bond a rubber strip to the outer surface of the pouch.

The invention has been described with references to preferred embodiments. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. A hydration system for providing fluid to a user, comprising:

a bladder configured to hold a fluid;

a multilayer outer protective skin surrounding said bladder, wherein the skin comprises a layer of a chemically resistant composite;

a spout connected to the bladder and in communication with the inside of the bladder, comprising a fill port for filling the bladder with fluid; and a tube connected to the bladder and in communication with the inside of the bladder, having a first end connected to an exit port of the bladder and having a second end connected to a fluid delivery fitting, wherein the spout further comprises a multi-part closure fitting that extends at least partially into the bladder and includes an opening through which fluid may enter or exit the bladder, the closure fitting comprising:

a base portion, said base portion further comprising a cylindrical neck with an opening therethrough, said cylindrical neck having a first threaded surface on an outer surface of said neck, and a second threaded surface on an inner surface of said neck; and a seal flange attached to one end of the neck, said seal flange extending substantially perpendicular to a longitudinal axis of said neck;

a sealing closure portion, said sealing closure portion further comprising a cylindrical body with an opening therethrough, said cylindrical body having a threaded surface on an inner surface of said body, said threaded surface on the inner surface of said body being sized and configured to mate with the threaded surface on the outer surface of said neck; a bottom flange attached to a bottom end of said body, said bottom flange extending substantially perpendicular to a longitudinal axis of said body; and a top flange attached to a top end of said body, said top flange extending substantially perpendicular to a longitudinal axis of said body; and a filler cap adapted to engage and close the fill port, said filler cap further comprising a cylindrical part, said cylindrical part having a threaded surface on an outer surface of said part, said threaded surface on the outer surface of said part being sized and configured to mate with the threaded surface on the inner surface of said neck; and a cap flange attached to a top end of said part, said cap flange extending substantially perpendicular to a longitudinal axis of said part;

wherein said seal flange is designed to fit through an opening in the bladder, and wherein said seal flange further comprises one or more indentations to tighten a connection between the base portion and the sealing closure portion.

2. The system of claim 1, wherein the bladder is flexible.

3. The system of claim 1 wherein the bladder comprises an inner layer of thermoplastic polyurethane.

4. The system of claim 1, wherein the tube is connected to the bladder at a different location than the spout.

5. The system of claim 4, wherein the tube is made of flexible plastic.

6. The system of claim 1, wherein the outer protective skin comprises a plurality of durable elastomer layers and at least one fabric reinforcement layer.

7. The system of claim 6, said outer protective skin comprising a fluorinated rubber composite.

8. The system of claim 7, wherein the fluorinated rubber composite comprises a polyamide reinforcing layer and a thermoplastic polymer layer.

9. The system of claim 1 wherein the filler cap is adapted to obstruct the opening through the base portion and the sealing closure portion.

10. The system of claim 1, said seal flange further comprising a plurality of concentric ridges and said bottom flange further comprising a plurality of concentric troughs, wherein said concentric ridges and concentric troughs are sized and configured to engage each other.

11. The system of claim 1, said top flange further comprising a plurality of concentric ridges and said cap flange further comprising a plurality of concentric troughs, wherein said concentric ridges and concentric troughs are sized and configured to engage each other.

12. A closure fitting for use with flexible bladders, comprising:

a base portion, comprising:

a cylindrical neck with an opening therethrough, having a first threaded surface on an outer surface of said neck, and a second threaded surface on an inner surface of said neck; and a seal flange attached to one end of the neck, said seal flange extending substantially perpendicular to a longitudinal axis of said neck;

a sealing closure portion, comprising:

a cylindrical body with an opening therethrough, having a threaded surface on an inner surface of said body, said threaded surface on the inner surface of said body being sized and configured to mate with the threaded surface on the outer surface of said neck;

a bottom flange attached to a bottom end of said body, said bottom flange extending substantially perpendicular to a longitudinal axis of said body; and a top flange attached to a top end of said body, said top flange extending substantially perpendicular to a longitudinal axis of said body; and a filler cap, comprising:

a cylindrical part, having a threaded surface on an outer surface of said part, said threaded surface on the outer surface of said part being sized and configured to mate with the threaded surface on the inner surface of said neck;

a cap flange attached to a top end of said part, said cap flange extending substantially perpendicular to a longitudinal axis of said part;

wherein said seal flange is designed to fit through an opening in a bladder to which said closure fitting is attached, and wherein said seal flange further comprises one or more indentations to tighten a connection between the base portion and the sealing closure portion.

13. The closure of claim 12 wherein the filler cap is adapted to obstruct the opening through the base portion and the sealing closure portion.

14. The closure of claim 12, said seal flange further comprising a plurality of concentric ridges and said bottom flange further comprising a plurality of concentric troughs, wherein said concentric ridges and concentric troughs are sized and configured to engage each other.

15. The closure of claim 12, said top flange further comprising a plurality of concentric ridges and said cap flange further comprising a plurality of concentric troughs, wherein said concentric ridges and concentric troughs are sized and configured to engage each other.

* * * * *